US005924297A

United States Patent [19]

Wolff et al.

[11] Patent Number: 5,924,297

[45] Date of Patent: Jul. 20, 1999

[54] REFRIGERATED MERCHANDISER WITH MODULAR EVAPORATOR COILS AND "NO DEFROST" PRODUCT AREA

[75] Inventors: Patrick J. Wolff, Florissant; Michael E. DeVore, Bridgeton, both of Mo.; Susan M. Polson, Maryville, Ill.

[73] Assignee: Hussmann Corporation, Bridgeton, Mo.

[21] Appl. No.: 08/963,449

[22] Filed: Nov. 3, 1997

[51] Int. Cl.[6] ..... F25D 21/02

[52] U.S. Cl. ..... 62/152; 62/155; 62/234

[58] Field of Search ..... 62/151, 152, 155, 62/156, 234, 282, 80, 81, 82

[56] References Cited

U.S. PATENT DOCUMENTS

| | | | |
|---|---|---|---|
| 2,075,838 | 4/1937 | Torrey | 62/116 |
| 2,133,963 | 10/1938 | McCloy | 62/4 |
| 2,219,912 | 10/1940 | Bireley | 62/89.5 |
| 2,254,420 | 9/1941 | Cleveland | 62/102 |
| 2,490,413 | 12/1949 | Burtis | 62/89.5 |
| 2,495,554 | 1/1950 | Spangler | 62/89.5 |
| 3,147,602 | 9/1964 | Beckwith | 62/278 |
| 3,196,626 | 7/1965 | Gabler | 62/89 |
| 3,434,299 | 3/1969 | Nussbaum | 62/199 |
| 3,914,952 | 10/1975 | Barbier | 62/197 |
| 4,084,388 | 4/1978 | Nelson | 62/152 |
| 4,151,723 | 5/1979 | Garnder | 62/156 X |
| 4,530,217 | 7/1985 | Alluto et al. | 62/156 |
| 4,899,554 | 2/1990 | Kato | 62/442 |
| 5,035,119 | 7/1991 | Alsenz | 62/225 |
| 5,379,608 | 1/1995 | Ishimaru et al. | 62/156 X |
| 5,709,096 | 1/1998 | Tamai et al. | 62/156 X |
| 5,727,393 | 3/1998 | Mahmoudzadeh | 62/81 |
| 5,743,098 | 4/1998 | Behr | 62/80 |
| 5,743,102 | 4/1998 | Thomas et al. | 62/185 |

*Primary Examiner*—Harry B. Tanner
*Attorney, Agent, or Firm*—Richard G. Heywood

[57] ABSTRACT

The invention comprises a merchandiser having a refrigerated product area with a plurality of product zones and separate air flow circulation means for the respective product zones, laterally adjacent modular cooling coils associated with the respective air flow circulation means and having a normal air flow cooling mode, and defrosting means constructed and arranged for selectively discontinuing the normal cooling mode of one modular cooling coil to effect a defrosting mode thereof during a period of continued normal cooling mode operation of another of said modular cooling coils, and thereafter defrosting another modular cooling means after re-establishing normal air flow cooling of said one modular cooling coil. The invention further comprises the method of defrosting separate modular cooling coils on staggered defrost cycles to maintain at least partial cooling air flow to the merchandiser product area at all times.

34 Claims, 11 Drawing Sheets

REFRIGERATED MERCHANDISER WITH MODULAR EVAPORATOR COILS AND "NO DEFROST" PRODUCT AREA

BACKGROUND OF THE INVENTION

1. Field of the Invention

This invention relates generally to the commercial refrigeration art, and more particularly to improvements in food product merchandisers and defrost control systems therefor.

2. Related Application

This application discloses improvement subject matter in common with co-pending and commonly-owned application Ser. No. 08/655,157 filed May 29, 1996 (as a continuation of Ser. No. 08/407,676 filed Mar. 14, 1995) and entitled Refrigerated Merchandiser With Modular Evaporator Coils and EEPR Control, now U.S. Pat. No. 5,743,098.

3. Description of Prior Art

Great advances have been made in the last forty years in the field of commercial food merchandising with the improved insulation materials, better refrigerants, more efficient air handlers and condensing unit systems, better lighting and the universal use of ambient air temperature and humidity control in food stores and the like. A long checklist of important factors influence the construction and manufacture of food merchandisers including refrigeration requirements and performance, structural engineering for strength, durability and safety as well as insulation effect, servicing capability, product merchandising potential, and both manufacturing and operating costs.

In today's marketplace a wide variety of food merchandisers are used to best market different types of food products as well as meet their cooling needs. In the low temperature field, frozen food merchandisers maintain product display temperatures at about 0° F. and ice cream cases operate at about −5° F. to −10° F. Frozen foods are best protected in reach-in coolers (with glass front doors), but open front, multi-deck merchandisers best display various food products. Similarly, in the medium temperature field of 28° F. to 50° F. product temperatures, glass front deli merchandisers are generally preferred for the marketing of freshly cut meats, cheeses, salads and other deli items, but open front multideck merchandisers are widely used for packaged meat and dairy products and single deck cases are preferred for fresh produce.

Although there has been some industry standardization at eight (8') foot and twelve (12') foot merchandiser lengths, the manufacture of commercial refrigerator fixtures has generally remained a hands-on operation. Thus, in the past, most commercial merchandisers have been cooled by conventional vapor phase refrigerant systems and typically have utilized fin and tube type evaporator coils which extend the full length of the merchandiser to best achieve uniform air cooling for delivery to the product area from end-to-end throughout the length of the merchandiser. In some of these applications, the evaporator coil was divided or split into two or more full length sections connected in series refrigerant flow relationship and typically arranged in a sequential air flow relationship in the bottom section and/or immediately adjacent in the lower back wall of the merchandiser cabinet. More recently, there has been development work in utilizing non-compressible liquid chemical coolants (so called "glycol-type" systems using glycol or ethylene solutions or some other secondary heat transfer liquid) for producing the merchandiser cooling effect; but conventional types of cooling coil configurations have been employed for these systems. In any event, such coils and the control valving therefor were generally accessible only from the inner lower well area of the product zone for maintenance or service. Such a location does not interfere with the structural soundness of a coffin-type merchandiser, but full length back wall coil locations limit the structural support capability for internal vertical frames in multi-deck merchandisers, as well as the cantilever suspension of glass front panels in deli merchandisers, as in commonly assigned U.S. Pat. No. 5,639,149.

The commonly assigned, co-pending application Ser. No. 08/655,157 (U.S. Pat. No. 5,743,098) discloses improvements in an air cooling and control system for a refrigerated food merchandiser having plural modular cooling coil sections of preselected heat exchange potential and being arranged in horizontally spaced apart disposition, and refrigerant metering means for controlling liquid refrigerant flow on the high (inlet) side of the evaporator sections, and other refrigerant metering and electronic control means for regulating suction pressure and refrigerant vapor flow on the low (outlet) side of the evaporator sections.

Another commonly owned U.S. Pat. No. 5,577,826 disclosed modular external frame structures for refrigerated merchandisers whereby to better accommodate placement of the modular coil section arrangements of U.S. Pat. No. 5,743,098

SUMMARY OF THE INVENTION

The invention is embodied in a refrigerated merchandiser having an insulated cabinet for a product area having a plurality of zones and separate air flow delivery means for each product zone, modular cooling coils associated with the respective air flow means for the normal cooling thereof, and defrosting control means constructed and arranged for stopping the normal cooling of a selected cooling coil during continued normal cooling of another cooling coil and thence sequentially defrosting the other cooling coils while re-establishing normal cooling of the one cooling coil. The invention is also embodied in the method of defrosting the modular cooling coils of the merchandiser to provide substantially continuous cooling of the product area.

It is a principal object of the present invention to provide modular cooling coils that facilitate modular design and fabrication for different refrigerated fixtures; that maintain better product temperatures; that can be used in multiple, parallel-piped sections with one or more liquid metering controls; that are responsive to separate, selective defrost controls; and that accommodate ease of manufacture, installation and service. An important feature of the invention is in controlling the operation of commercial refrigerator cooling means to maintain preselected food zone temperatures at substantially constant values. Still another object is to provide an improved apparatus and control strategy for regulating the defrosting of separate modular refrigeration coils to achieve operating temperatures while maintaining display area temperatures even during modular coil defrosting. These and still other objects and advantages will become more apparent hereinafter.

DESCRIPTION OF THE DRAWINGS

In the accompanying drawings which form a part of this specification and wherein like numerals refer to like parts wherever they occur.

DESCRIPTION OF THE PREFERRED EMBODIMENTS

For disclosure purposes different embodiments of the modular cooling coil and defrost control of the present invention are shown in different commercial food display cases or merchandisers as may be installed in a typical supermarket. Such display cases are generally fabricated in standard eight (8') foot and twelve (12') foot lengths, but may be arranged in a multiple case line-up of several merchandisers operating in the same general temperature range. Low temperature refrigeration to maintain display area temperatures of about 0° F. for frozen foods requires coil temperatures generally in the range of −5° F. to −20° F. to achieve exit air temperatures at about −3° F. to −11° F.; and medium temperature refrigeration to maintain fresh food product area temperatures in the range of 34° F. (red meat) to about 50° F. (produce) requires coil temperatures generally in the range of about 15° F. to 28° F. with corresponding exit air temperatures at about 24° F. to 40° F. It is clear that a "closed" front case, such as a deli or reach-in having glass panels, will be easier to refrigerate than an open front, multideck merchandiser and that the nature and amount of insulation are also major design factors.

Also for disclosure purposes it will be understood that various commercial refrigeration systems may be employed to operate the air cooling and control systems of the present invention. For instance, conventional closed refrigeration systems of the "back room" type having multiplexed compressors may be used, or merchandisers of the present invention may be operated by strategically placed condensing units located in the shopping arena or service area—of the type disclosed and claimed in commonly owned U.S. Pat. No. 5,440,894. In either event, the general operation of refrigeration systems will be understood and readily apparent to those skilled in the art, and various refrigerant terms such as "high side" and "low side" and "exit air" will be used in a conventional refrigeration sense. Further, since the present invention is an improvement to the invention disclosed and claimed in co-pending application Ser. No. 08/655,157 U.S. Pat. No. 5,743,098, that prior application is incorporated herein in its entirety by reference for disclosure purposes. It will be understood that vapor phase refrigerant systems have been used to disclose preferred embodiments, but that glycol-type coolant systems may also incorporate-the inventive features and thus the respective disclosures of two commonly-owned and co-pending U.S. applications Ser. No. 08/631,104 (entitled Multi-Stage Cooling System for Commercial Refrigeration, now U.S. Pat. No. 5,743,098) and Ser. No. 08/632,219 (entitled Strategic Modular Secondary Refrigeration, now U.S. Pat. No. 5,743,102) are incorporated herein in their entirety by reference for disclosure purposes.

Figure 1:
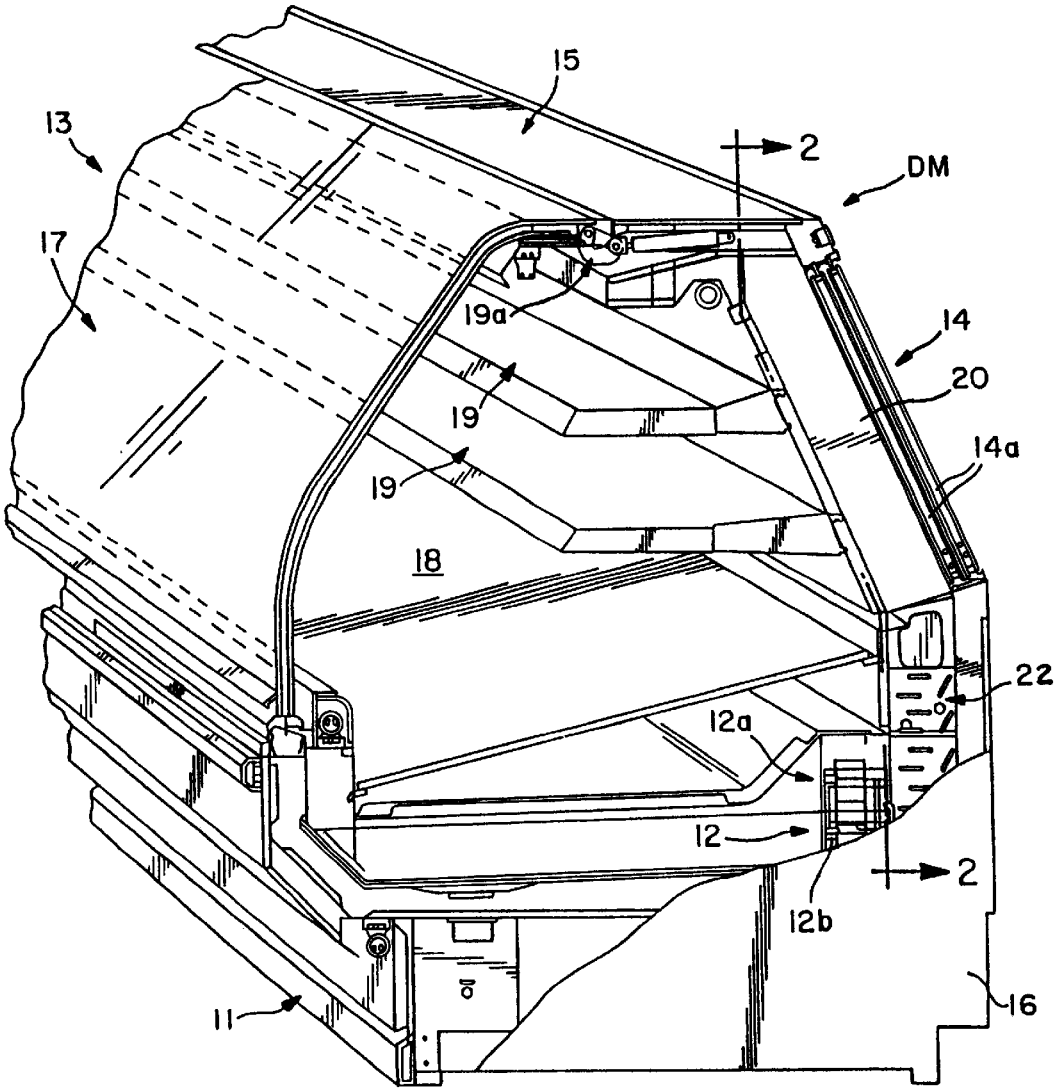
FIG. 1 is a vertical cross-sectional view—in extended fragmentary perspective—illustrating a glass front deli merchandiser environment embodying the present invention.
Figure 2:
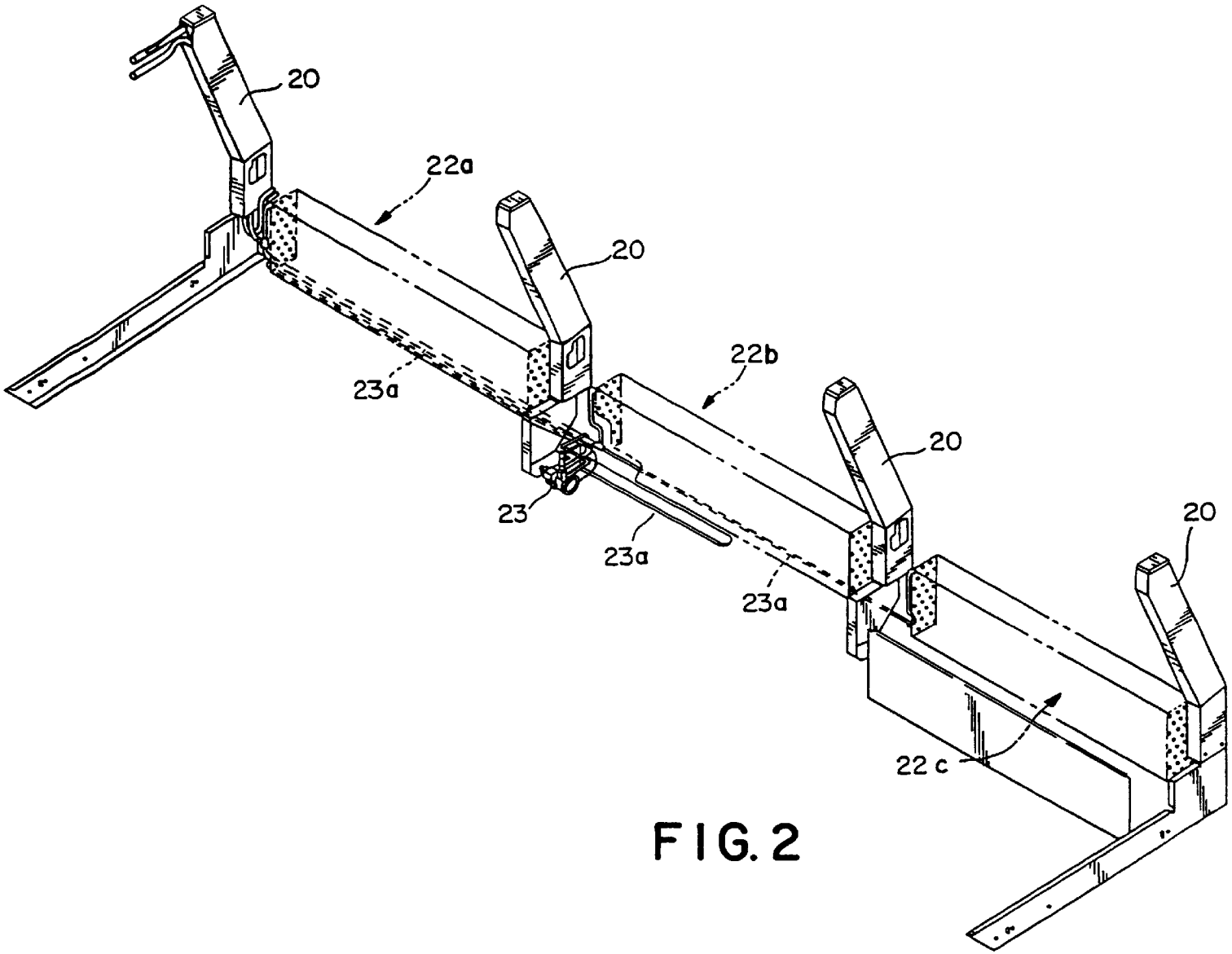
FIG. 2 is a fragmentary perspective view taken substantially along line 2—2 of FIG. 1 and showing one embodiment of the modular evaporator coil features of the invention.
Figure 3:
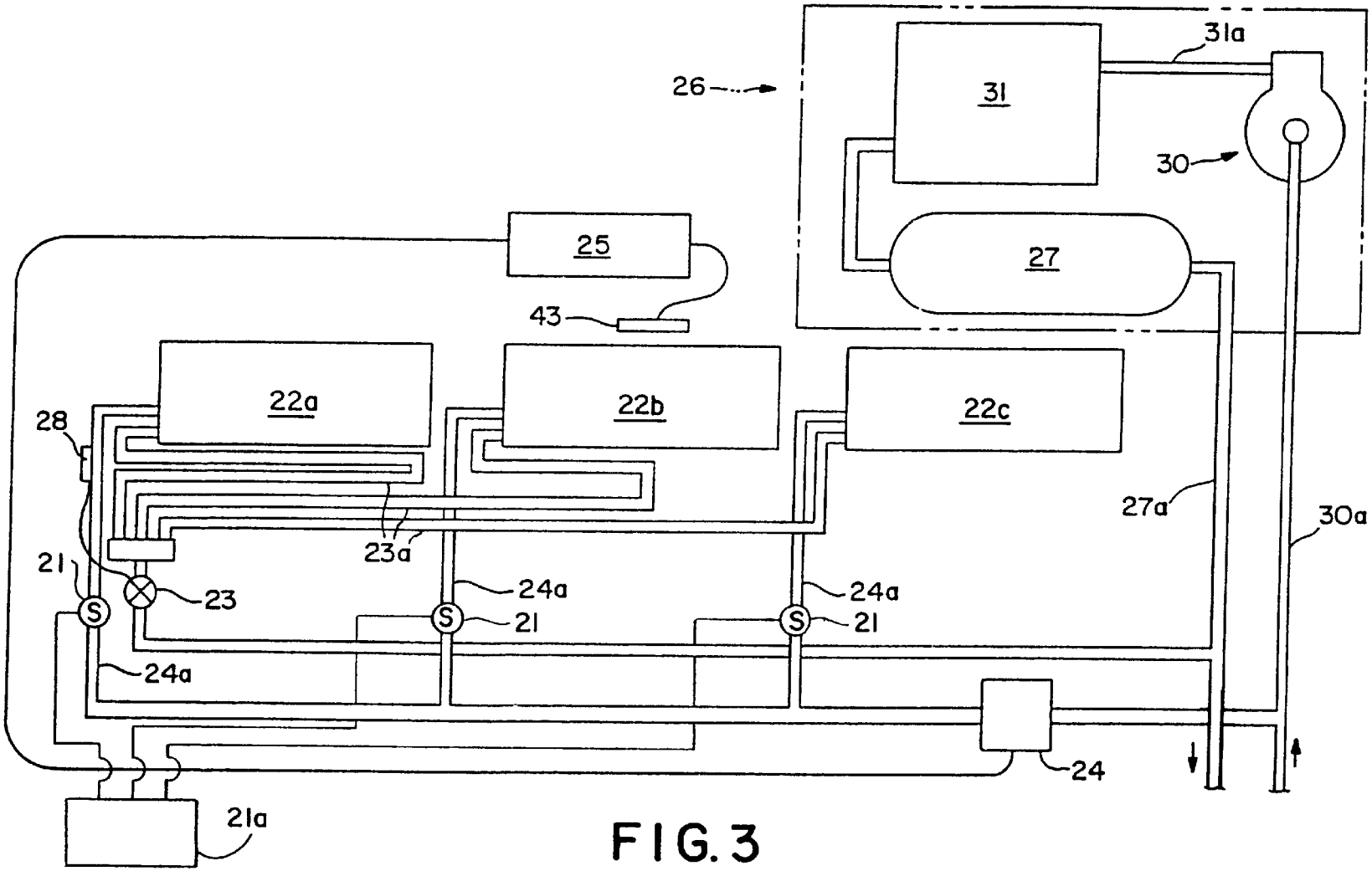
FIG. 3 is a diagrammatic representation of the FIG. 2 modular coil embodiment.

Referring to FIGS. 1–3, a closed deli merchandiser DM basically comprises a cabinet with a lower base section 11 housing air circulation means 12 and having an upper cabinet or display section 13. The upper cabinet section 13 has a sloping rear service wall 14 constructed and arranged to provide sliding access service doors 14*a*, a short horizontal top wall 15, end walls 16 and double-curved glass front panels 17 conforming generally to the configuration of the end wall front margin and which together define a refrigerated product display zone 18 having shelf means 19 therein. The lower section 11 and the rear, top and end walls of the upper section 13 will be insulated as needed to maintain optimum refrigerated conditions in the display area 18. The glass panels 17 normally close the product area 18 from ambient but are hinged, at 19*a*, for opening movement for stocking, cleaning or service. The weight of these panels 17 when opened is translated to the base 11 through struts 20, which are spaced apart and accommodate the sliding doors 14*a* therebetween. The air circulating means 12 comprises a plenum chamber 12*a* in the bottom of the cabinet 13, and plural fans 12*b* to re-circulate air through the cabinet and display area 18.

A feature of the invention resides in the refrigeration or cooling means for the merchandiser DM, and specifically in the use of plural modular evaporator coil sections 22 in lieu of conventional full length coils. The refrigerant metering control for the merchandiser DM includes a high side liquid control or metering means in the form of a thermostatic expansion valve 23 and may also include a low side suction control or metering means in the form of an EEPR valve 24 and electronic controller 25 therefor, as more fully described in co-pending application Ser. No. 08/655,157.

Referring to FIG. 3 wherein a typical refrigeration system 26 is illustrated, it will be seen that the expansion valve 23 receives high pressure liquid refrigerant from the system receiver 27 through liquid line 27*a* and meters liquid through a distributor (not shown) and feed lines 23*a* to the modular coils 22*a*, 22*b* and 22*c* in response to suction temperature/pressure sensed by bulb 28 in a conventional manner. In addition, as a feature of the invention refrigerant flow through each of the modular coil sections 22*a*–22*c* in normal refrigeration and defrost modes in this embodiment is controlled by other coolant flow control means, such as solenoid valves 21 and a defrost controller 21*a*, to be described. The suction lines 24*a* from the modular coils 22 are constructed and arranged with the EEPR valve 24 on the low side to return superheated refrigerant vapor to the suction side of the system compressor means 30 through main suction line 30*a*. The compressor means 30 discharges high pressure vaporous refrigerant through discharge line 31*a* to condenser 31, in which the refrigerant is cooled and condensed to a liquid state and discharged through line 31*b* to the receiver 27 to complete the circuit. As indicated by the arrows at the liquid and suction lines 27*a*, 30*a*, the refrigeration system 26 may operate additional food merchandisers in the same temperature range.

The modularity of the evaporator coil concept accommodates the use of modular internal-external support frame structures to effectively support most commercial merchandiser cabinets—whether single deck as in deli and produce types, or 2–5 multideck cases for frozen foods, meat or dairy, and the cabinet frame members carry the weight of insulated panels, shelving and duct forming members and translate it to an external frame assembly. Thus, the modular evaporator coils 22—while of conventional fin and tube configuration—are preferably standardized in four (4') foot lengths to accommodate more flexibility in placement and facilitate the use of modular framing, as disclosed in commonly assigned U.S. Pat. No. 5,577,826.

Still referring to FIGS. 1–3, the plurality of modular coils 22 in the merchandiser are constructed and arranged in horizontally spaced, end-to-end relationship to cool separate air flows and deliver them to horizontally adjacent sections of the display area 18. FIG. 2 indicates that the deli merchandiser DM of FIG. 1 is a twelve foot case, and thus has three equal sized coil sections 22*a*, 22*b* and 22*c* which are disposed between the structural struts 20 in this closed-type merchandiser. In this embodiment, the high side liquid control means comprises a single thermostatic expansion valve 23 arranged to deliver equal amounts of refrigerant or coolant to each of these coil sections (22), and thus the feed lines 23*a* are constructed and arranged to be the same length from the expansion valve outlet into the respective coil sections 22*a*, 22*b* and 22*c*. The placement of the expansion valve 23 at the center coil section 22*b* means that the feed line 23*a* thereto has to be bent or otherwise constructed and arranged to accommodate the extra tubing length relative to the shorter direct distance between the valve 23 and center coil 22*b*. The liquid control means further comprises the refrigerant flow control means in the form of the solenoid valves 21 either on the high side or the low side of the modular coils 22, as will be described.

Figure 4:
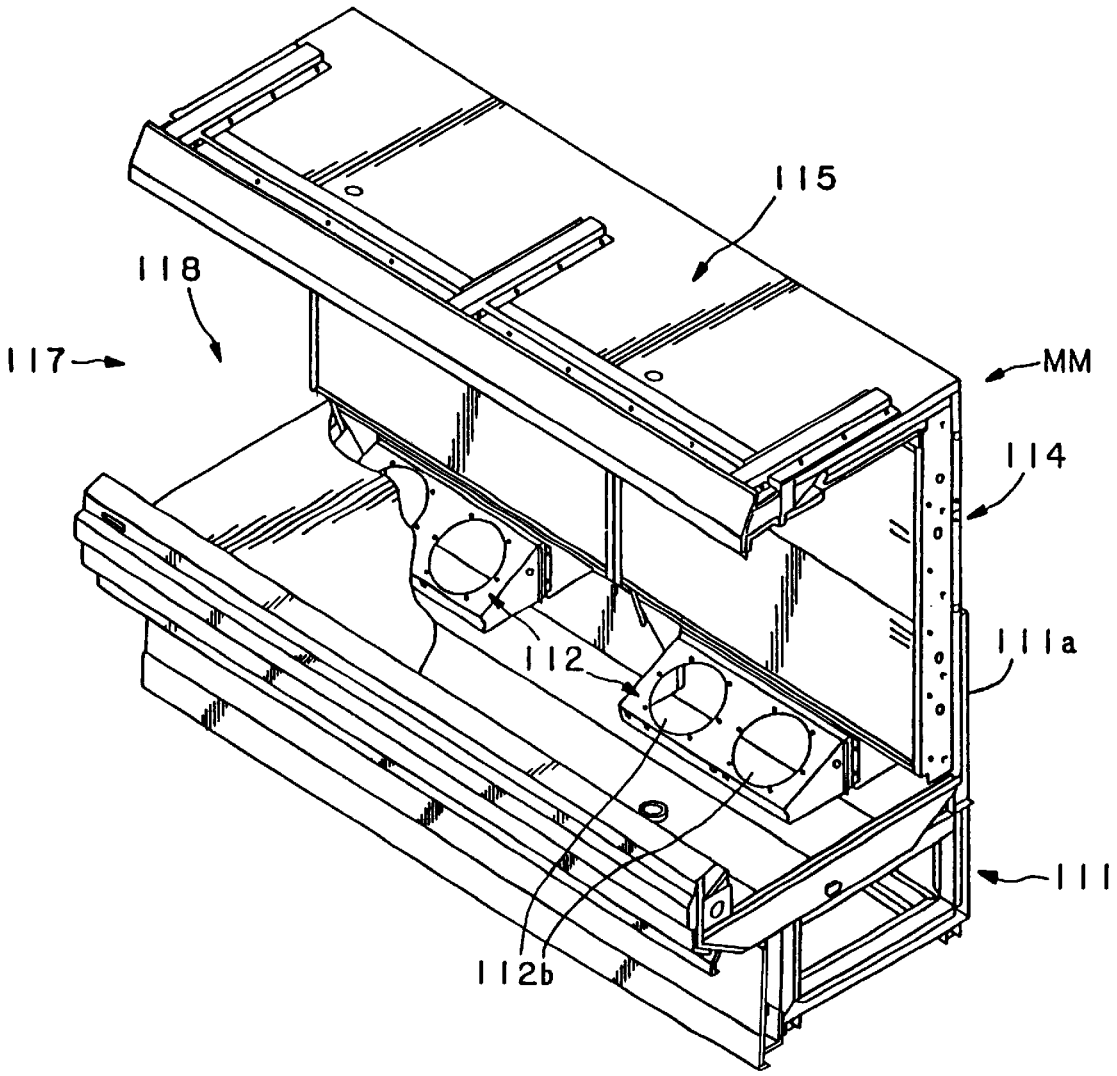
FIG. 4 is a perspective view, partly broken away, illustrating an open front, multideck merchandiser environment embodying the present invention.
Figure 5:
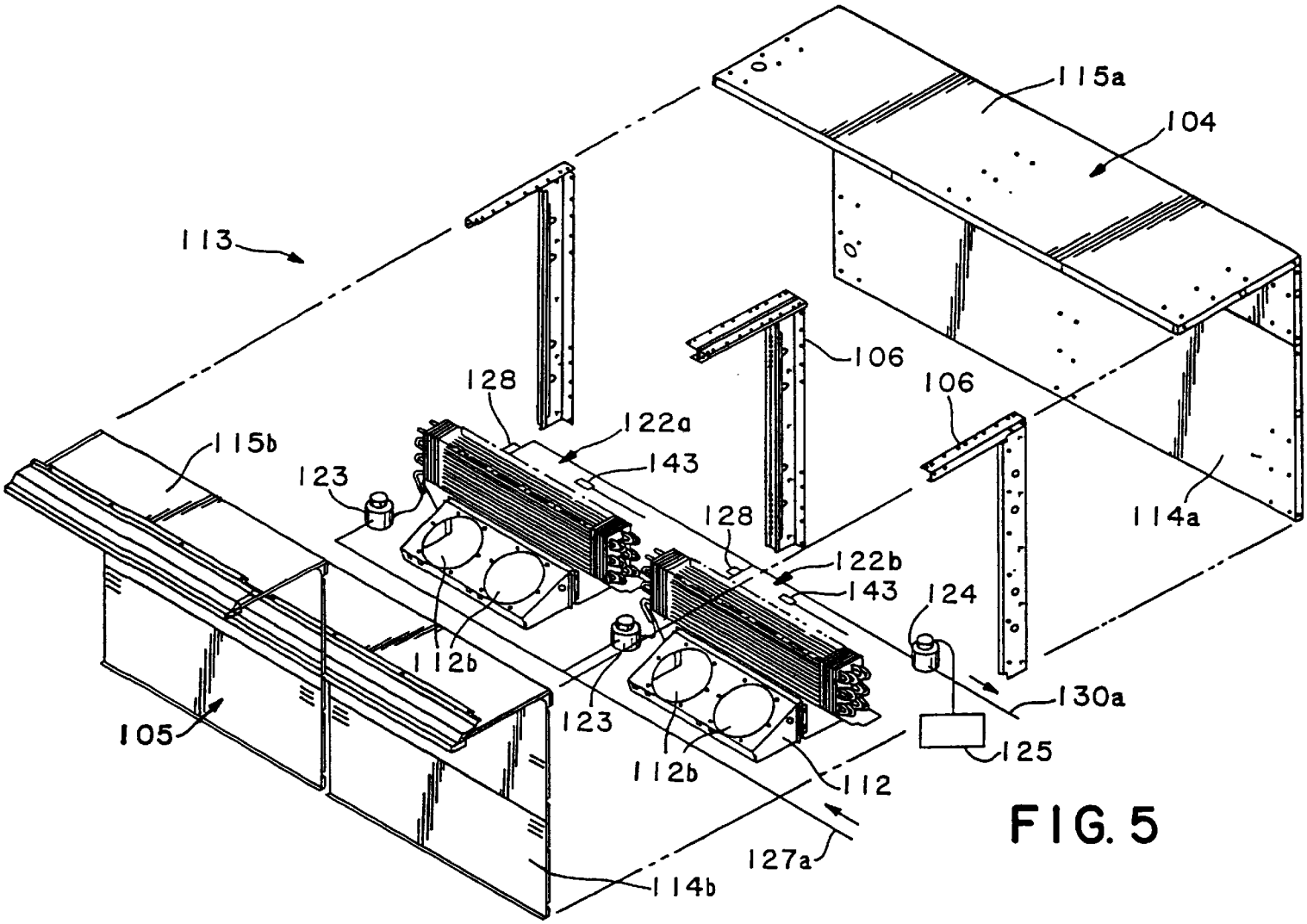
FIG. 5 is an exploded view of the insulated cabinet and air control components of FIG. 4 and showing another embodiment of the modular coil.
Figure 6:
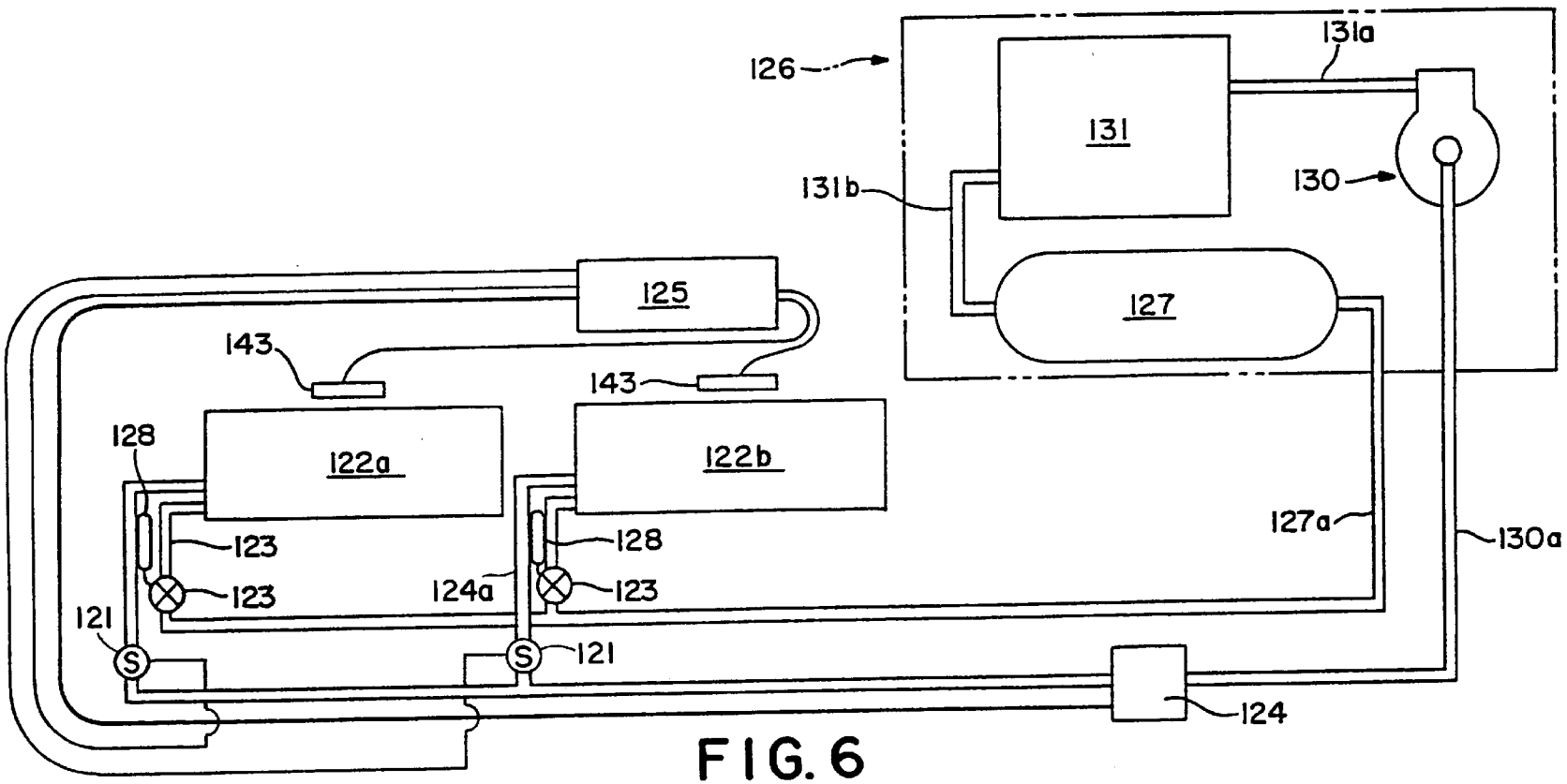
FIG. 6 is a diagrammatic representation of the FIGS. 4 and 5 embodiment.

It will be understood that air temperature control in the product zone of a closed single deck deli merchandiser DM is more easily accomplished than in the product zone of an open front, multideck merchandiser, such as the four deck meat merchandiser MM of FIGS. 4–6. Thus, the single expansion valve 23 may be used in the deli case DM with the use of separate solenoid valves 21 in each of the suction lines 24*a* from the respective modular coil sections 22, and a single sensor 43 may be employed in the control of the EEPR valve 24.

It will be understood that the functions of the controller 25 for the EEPR valve 24 and the controller 21*a* for the solenoid valves 21 may be part of the same electronic case or master controller or microprocessor for the system.

A principal feature of the invention is to provide a substantially constant cooling effect to the merchandiser product area so that it will be less sensitive to the periodic defrosting of the respective coil sections 22*a*, 22*b* and 22*c*. In the past, it has been traditional to defrost the entire evaporator coil for a display merchandiser, usually using electric defrost or hot gas defrost, and to do so as rapidly as possible in order to minimize product temperature rise due to the defrost heat loads imposed on the coils. According to the present invention utilizing modular coils (22) and low side flow control means (21*a*), the refrigeration mode to each coil section can be interrupted for a selected off-time defrost period adequate to permit the coil defrost to occur using only sensible heat from recycled return air and without inputting or imposing any positive heat load, such as by the electric or hot gas defrost methods. Thus, if coil section 22*b* is in a defrost mode, the other coil sections 22*a* and 22*c* will continue their normal refrigeration or cooling phase and the cold air flow will continue to be circulated through and cool the respective product area zones with a spread of the cooling effect into the adjacent inoperative zone of the defrosting coil 22*b*. An off-time defrost of a coil section might last for 3–30 minutes or longer depending on a variety of factors that would influence the speed and degree of coil icing during a cooling cycle, and the off-cycle defrost in extreme cases may be terminated by sensing coil temperature and adjusting drip time rather than relying upon a timed sequence per se. In any event, when coil section 22*b* is defrosted and the controller 21*a* returns it to normal refrigeration, then another coil section (i.e., 22*a*) will be sequenced or alternated into its off-time defrost mode—generally on the same basis as the other coils. The coil section 22*c* would then be defrosted and the coil sections for any merchandiser would follow a predetermined defrosting sequence. The frequency of off-cycle defrosting may vary from 3 to 24 times daily depending on the type of merchandiser and extent of frost or ice accumulation. Clearly, if the time frame for effectively defrosting a coil is shorter (i.e., 3 minutes) then the frequency of daily defrosts can be increased (i.e., 12 to 24 or every 1 to 2 hours).

Referring to FIGS. 4–6, the open front multideck merchandiser MM is described with reference numerals in the "100" series. The merchandiser MM has a lower structural base frame 111 and an external vertical structural frame 111*a* that carries an upper cabinet section 113 with a rear panel 114, a top wall 115, end walls (not shown) and together defining a refrigerated product display zone 118 having a front opening 117. Suitable shelving (not shown) or other product display means (i.e. pegboard) are mounted in the display zone area 118. The exploded view of FIG. 5 illustrates that the upper cabinet 113 is comprised of an outer insulated panel 104 having a vertical back section 114*a* and top section 115*a*, and an inner panel or liner 105 having a vertical section 114*b* and a horizontal top section 115*b*. These outer and inner panels 104 and 105 are assembled in spaced relation by spaced internal frame members 106 to define connecting rear and top air distribution ducts (not shown). A lower cabinet panel 107 covers an air duct 112*a* which connects with air circulating plenums 112 having fans 112*b*. Modular coil sections 122*a* and 122*b* are disposed in horizontal end-to-end relationship between the internal frames 106 and communicate with the air circulating means 112 to cool the air flow to produce design exit air temperatures for product cooling in the display zone 118.

In the embodiment of FIGS. 4–6, the liquid control means comprises a separate expansion valve 123 for each coil section 122*a* and 122*b*, which may be operated independently in response to its own sensing bulb (128) and preset condition. An EEPR valve 124 and its controller 125 are positioned within the merchandiser and employ separate air temperature sensors 143 downstream of the respective coils 122. Defrost control solenoids 121 are shown on the suction side of the evaporators 122, and FIG. 6 shows that electronic controller 125 may be used as the defrost controller in this embodiment in lieu of a separate controller (121*a*) or a master system controller.

Figure 8:
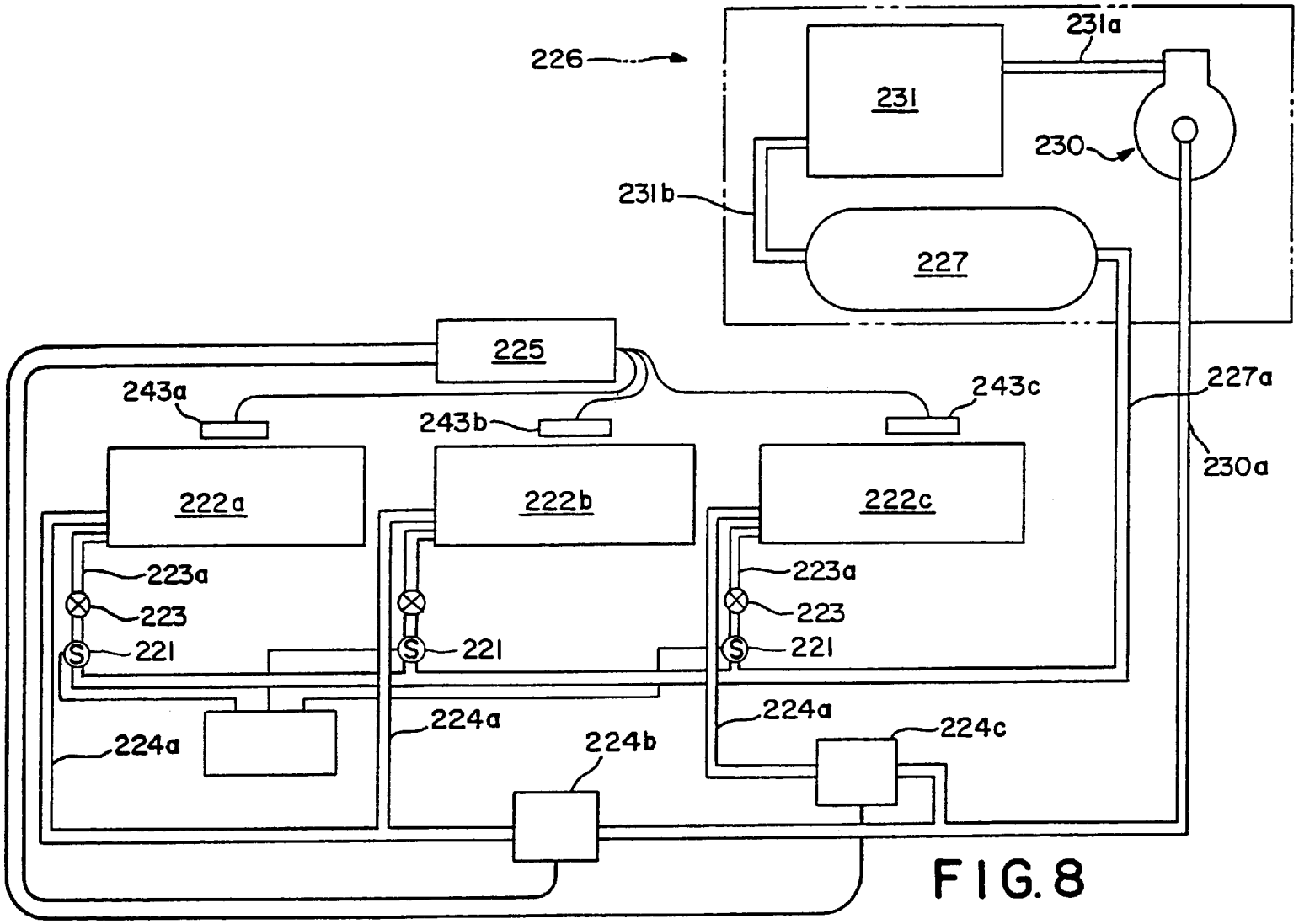
FIG. 8 is a diagrammatic depiction of a modified air cooling system for the FIG. 7 embodiment.

Actual metering of refrigerant through the evaporators 22, 122 for refrigeration of the merchandiser product zone 18, 118 is carried out by one or more expansion valves 23, 123 and one or more EEPR valves 24, 124. The configuration shown in FIG. 3 comprises a single expansion valve 23 and a single EEPR valve 24. In FIG. 6, there is shown one expansion valve 123 for each evaporator section 122 and a single EEPR valve 124 on a common suction line therefrom. To control one coil at a different temperature than the other coils, its suction side may have its own EEPR valve, as shown in FIG. 8. In the preferred application, the amount of refrigeration carried out by the evaporators 22, 122 is controlled by operation of the EEPR valves 24. The function of the expansion valves 23, 123 is to optimize the refrigeration operation by maintaining an optimal refrigerant superheat value (e.g., 5° F.) on the suction side of the evaporators, not to achieve temperature control. Thus, each expansion valve 23, 123 is modulated solely in response to the temperature of the refrigerant detected by sensing bulb 28, 128 located on the suction side of the evaporator. The expansion valves 23, 123 and their corresponding sensing bulbs 28, 128 can be arranged in several different configurations. For instance, the single expansion valve 23 used for all three evaporators, as in the FIG. 3 embodiment, is controlled by the sensing bulb 28 located on the suction line just downstream of the last evaporator. As shown in FIG. 6 (and FIG. 8 to be described), each evaporator 122 has its own dedicated expansion valve 123 which is operated by the sensing bulb 128 located adjacent to the outlet of that evaporator.

These disclosed embodiments are to be contrasted with more conventional evaporator temperature control by expansion valves which are modulated in response to detected exit air temperature from the evaporators. Exit air temperature control for a particular evaporator by operation of an expansion valve at a substantially constant suction pressure will result in variations in the superheat of the refrigerant leaving the evaporator. For example, when the exit air temperature is too cold, the expansion valve throttles down and reduces the refrigerant flow entering the evaporator. As a result, all of the refrigerant in the evaporator is completely vaporized well prior to reaching the outlet of the evaporator. Failure to keep the evaporator substantially full of boiling refrigerant causes a loss in efficiency, non-uniform frost build up on the evaporator requiring more frequent defrost cycles, and additional dehumidification. Locating the EEPR valve 24 near the evaporator closely controls saturated evaporator temperature, and the expansion valve functions to make sure that the evaporator operates efficiently by maintaining a substantially constant superheat. However, it will be understood that the defrost arrangement and method of the present invention can be carried out with either the preferred or more conventional expansion valve control.

Initiation of a defrost cycle could be controlled by a timer within the controller 21*a*, 121*a* by a master defrost timer located externally of the merchandiser and controlling the refrigeration and defrost cycles for a number of merchandisers in the system 126, or by detection of some parameter other than time. The preferred defrost method is by off-time (closing off either the high side liquid feed or the low side suction return by operating the solenoid valves 21, 121 or the like), and the air circulating means 12 associated with the defrosting coil will continue to operate to accelerate the warmer return air distribution through the coil. It should also be recognized that a defrost is typically carried out on a time line that has two components; namely, a de-icing period to fully melt the ice accumulation from the fins 34 and tubing 33 of the coil (which achieves a drip temperature) and a drip period to permit the water to run off the evaporator to prevent a re-freeze condition. It is contemplated that hot or latent gas defrost might also be used to start and accelerate the initial defrost de-icing period, in which case the fans 12 might be turned off during this portion of the de-icing period of defrost.

When a defrost of any coil section begins by the controller activating the solenoid valve circuit to stop its normal refrigeration mode, the temperature of the exit air from the defrosting coil may begin to rise, and the controller 25, 125 periodically averages the temperatures from the sensors 43, 143 to determine if the averaged temperature equals or exceeds a drip time temperature stored in the controller and empirically selected to be a predetermined exit air temperature value, as detected at the end of the de-icing period when all of the ice on the defrosting coil is gone.

Figure 7:
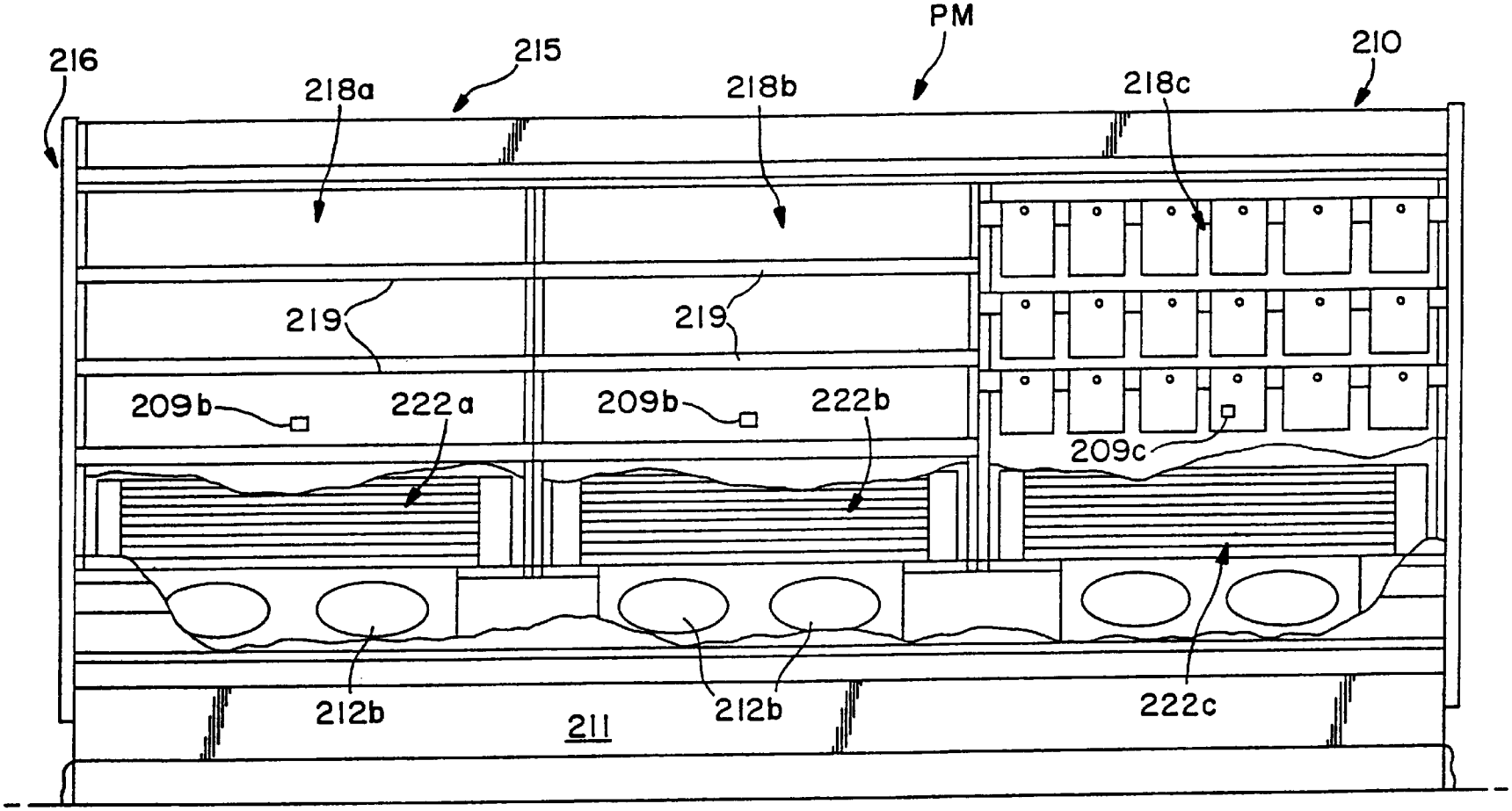
FIG. 7 is a diagrammatic front elevational representation of a typical twelve foot merchandiser to illustrate another modification of the invention.

Referring now to FIGS. 7 and 8 of the drawings, another modified embodiment is shown with reference to open front merchandiser PM of twelve foot length and having a cabinet 210 with three product cooling zones 218*a*, 218*b* and 218*c*. The product zones 218*a* and 218*b* are typical of the merchandiser MM shown and described with reference to FIGS. 4–6 in that these zones 218*a* and 218*b* have multiple shelves 219 for holding fresh foods such as meat or cheese requiring medium temperature refrigeration at temperatures of about 40° F. The product zone 218*c* represents a pegboard-type back panel (205) for the refrigerated display of pre-packaged products, such as cheese and cold cuts. It is known that the air distribution characteristics may differ between adjacent zones of shelving and pegboard or the like, and it may result that the air temperatures may be higher in one zone than desired. In the prior art, the solution was to operate the entire case at a lower evaporator temperature. With the modular coils, adjustment can be achieved between adjacent zones such as by operating the evaporator coil (222*c*) at a lower temperature to provide colder exit air temperatures. It is contemplated that, in addition to the temperature sensors 243*a*, 243*b* and 243*c* for the respective coils (222), product zone temperature sensors 209*a*, 209*b* and 209*c* may be provided and the data used by the controller 225 to achieve the operational balance desired. Referring particularly to FIG. 8, one EEPR valve 224*b* may be used to control two coil sections 222*a* and 222*b* and another EEPR valve 224*c* used for the colder operating coil 222*c*.

In this embodiment, the refrigeration flow control means (i.e., valves 221) are shown interposed in the liquid lines 223*a* upstream of the expansion valves 223, and these solenoid valves 221 are controlled by a case or master controller 221*a* or the same function can be programmed into the controller 225, as previously discussed.

In operation of the FIGS. 7–8 embodiment, a defrost is initiated in the selected coil section (222*a*) by closing its liquid line solenoid 221 and starting a predetermined off-time defrost cycle during the continued normal refrigeration of the other coils 222*b* and 222*c*. The defrost cycle can be terminated by preselected time or by sensed temperature deviation —that accommodate the necessary de-icing and drip time components. The merchandiser defrost then progresses sequentially to the next selected coil section (222*b*) while coil 222*a* resumes a normal refrigeration cycle and coil 222*c* continues its normal refrigeration; and the defrost thence progresses to coil 222*c* in the same manner.

The merchandiser PM might operate with the following typical temperatures:

coil temperature —24° F.

exit air temperature from coil —25° F.

discharge air temperature to display area —30° F.

product temperature —40° F.

Prior art case defrosting of full length evaporator coils in this type of merchandiser using electric or hot gas defrosting would probably be carried out 3 times daily for 30 minute defrost periods, and the average product temperature during defrost might go up from about 40° F. to about 41.6° F.—a rise of 1.6° F. In comparison, the same merchandiser embodying the features of the present invention might provide a modular coil defrost every 2 hours with a total defrost time of each coil section of about 15 minutes (inclusive of a defrosting or ice melting period and a drip-time period), and the observed average product temperature was at 39.6° F. during its cooling mode and rose to about 40.3° F. in the defrosting zone—a rise of about 0.7° F. Thus, it is seen that the shorter and more frequent defrosts of the modular coils on a staggered defrosting sequence result in the maintenance of lower product temperature during normal cooling cycles and a smaller rise in product temperature during a defrost. The staggered defrosting of the coils means that product area cooling in a zone adjacent to that of the defrosting coil will result in a lateral spread of the refrigerated air flow to the inactive zone.

It should be understood that solenoid valves 21, 121, 221 are presently preferred as flow control valve means for defrost purposes because of their economics, but that pulse-type electronic expansion valves (not shown but well-known in the refrigeration field) can be programmed with the dual function of (1) metering liquid refrigerant to the coil during normal refrigeration mode operation and (2) closing off liquid flow to effect a defrost mode of the coil. Similarly, the EEPR valve can be controlled to (1) regulate refrigerant flow on the suction side during a refrigeration mode and (2) shut down to effect a defrost mode.

Figure 9:
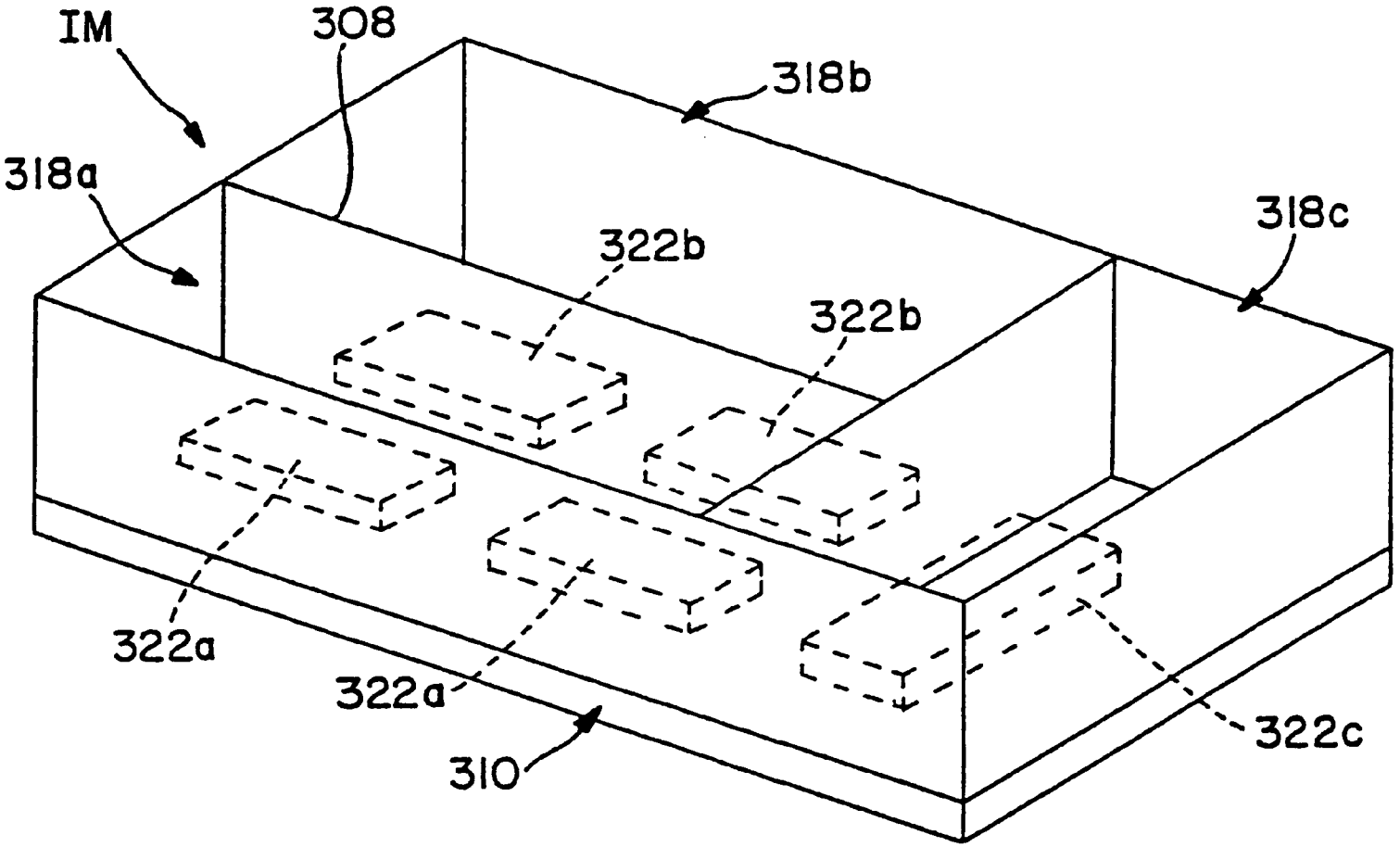
FIG. 9 is a diagrammatic perspective view of a multiple unit island display case illustrating another modified multiple evaporator.
Figure 10:
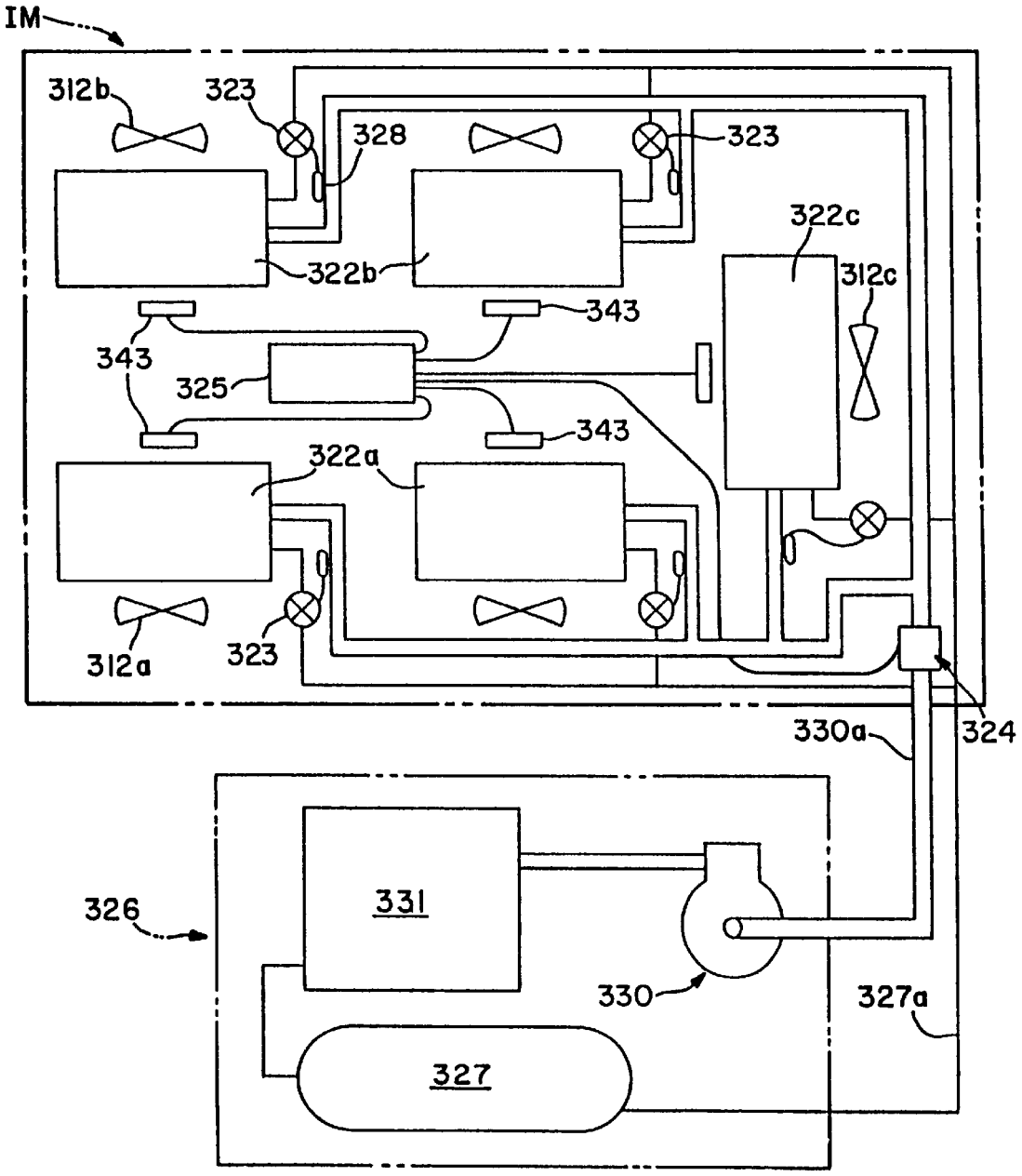
FIG. 10 is a diagrammatic depiction of the air cooling system for the FIG. 9 embodiment.

Referring to FIGS. 9 and 10, an island or "well" type merchandiser IM may be used for low temperature or medium temperature refrigeration. Such cases frequently are designed with plural product holding areas, and FIG. 9 shows a triple cabinet 310 having two parallel product zones 318*a* and 318*b* and an end zone 318*c* that extends laterally of the other zones. Typically, the two parallel zones 318*a* and 318*b* are arranged back-to-back with a common center wall 308 forming an internal air duct (not shown), and the end section 318*c* has an independent air cooling system. As shown best in FIG. 10, in one form of the invention each cooling zone (318) is refrigerated by evaporator coils (322*a* for zone 318*a*; 322*b* for zone 318*b*; and 322*c* for zone 318*c*). The suction from the multiple coils may be controlled by a single EEPR valve 324. The controller 325 operates the EEPR valve in response to exit air temperatures sensed by at least one sensor 343 for each air circulating system 312*a*, 312*b* and 312*c*.

Figure 11:
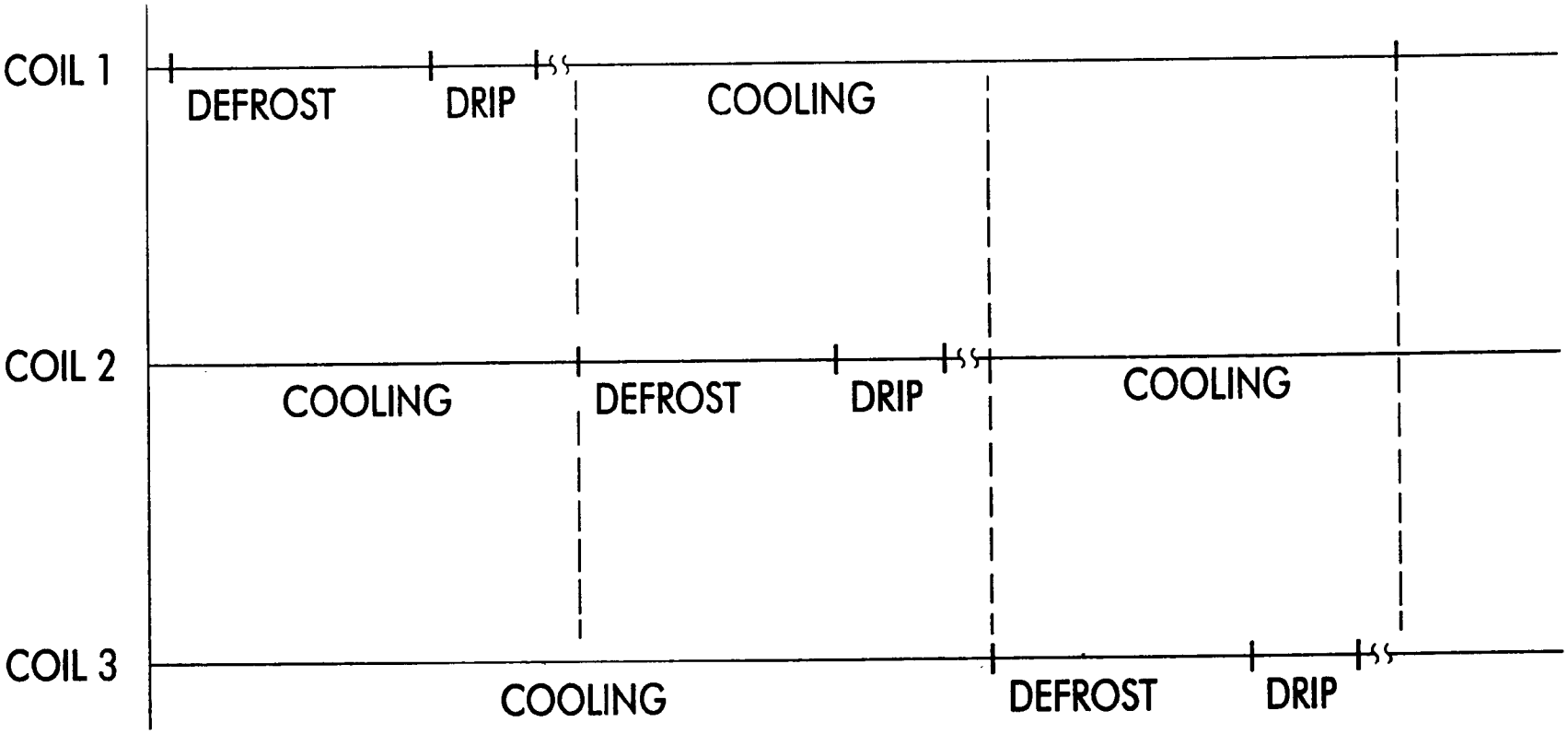
FIG. 11 is a diagrammatic view graphically illustrating a staggered defrosting sequence for a three coil modular system.

Since it is an object to maintain a substantially continuous cooling effect in the product area, it will be clearly understood that the modular cooling coils are not defrosted simultaneously (i.e., on a full display case defrost as in the past). Rather, in accordance with the invention, the modular coils are individually defrosted on a staggered sequence that accommodates a full defrost period followed by a drip time and temperature pull-down time (for start up of the refrigeration cycle and to re-establish full product zone cooling) for each coil before starting the defrost of any other coil. It is also highly desirable that all of the coils be operated in a refrigeration mode for a substantial period following the defrost mode of any coil to thereby maintain optimum product temperatures throughout the product area. The staggered sequencing of modular coil defrosts is best shown with reference to FIG. 11, in which "coil 1" (e.g., coil 222*a* of FIGS. 7–8) has its defrost/drip time mode during continuous operation of "coil 2" (e.g., coil 222*b*) and "coil 3" (e.g., coil 222*c*) in their refrigeration mode. "Coil 1" then returns to its refrigeration mode for a pre-scheduled time before "coil 2" goes on defrost (as indicated by the vertical dashlines in FIG. 11); and when "coil 2" starts its defrost/drip time mode the other coils ("coil 1" and "coil 3") remain in a full refrigeration mode. Similarly, "coil 3" starts its defrost/drip time mode when "coil 2" and "coil 1" are in a full refrigeration mode. In the example of FIGS. 7–8, the defrosting (frost melting) period may be about 12 minutes followed by a drip-time period of 3 minutes and a pull-down period of about 1 minutes for an aggregate defrost time of about 16 minutes. As shown in FIG. 11 by the breaks in the "cooling" periods following the "drip" periods, all of the coils may have a substantial concurrent cooling mode run-time, such as 20 minutes or longer, following the defrost cycle of each modular coil.

It will be understood that several factors may affect the length of the defrost period and the drip time period to assure a clean coil as well as the number (frequency) of daily defrosts required to obtain optimum coil cooling. Low temperature fixtures with 0° F. product area temperatures require coil temperatures in the range of −3° F. to −10° F. depending upon such factors as the volume ("cube") of the product area and whether it is closed by doors or open to the store environments—in which case environment temperature and humidity control become factors. Thus, heavy coil icing can be expected in low temperature refrigeration and longer and more frequent defrost periods will be scheduled, such as a 30 minute defrost period followed by a 5 minute drip time and 2 minute pull-down to achieve full coil refrigeration temperature with a daily frequency of 16 times for each modular coil. By contrast, in a single shelf, open produce merchandiser having product area temperatures of about 50° F., the coil operating temperature may be set at about 40° F. and result in light frosting or snow-type accumulation that is relatively quickly removed in a 2–5 minute defrost with a 0.5–1.0 minute drip time and negligible pull-down time and the daily frequency may be 12 times for each modular coil. Defrost/drip time periods in the range of 15–20 minutes at intervals of 6 to 12 times daily may be useful for fresh meat and dairy merchandisers. An objective of the defrost scheduling is to keep the defrost periods as short as possible to best keep the product area at design temperature. Plus, it may be desirable with off-time defrosting to have shorter defrosts at more frequent intervals since heavier frost and ice accumulates on the coil the longer it remains in a refrigeration mode and requires longer defrost and drip times to clean the coil.

The scope of the invention is intended to encompass such changes and modifications as will be apparent to those skilled in the art, and is only to be limited by the scope of the appended claims.

What is claimed is:

1. In combination with a merchandiser cabinet having a continuous refrigerated product area defined by a plurality of contiguous product zones and separate air flow circulation means for each of the respective product zones, laterally adjacent modular cooling means associated with the respective air flow circulation means and together producing a normal air flow cooling mode; the improvement comprising defrosting means constructed and arranged for selectively discontinuing the normal cooling mode of one modular cooling means to effect a defrosting mode thereof during a period of continued normal cooling mode operation of another of said modular cooling means, and thereafter defrosting another modular cooling means after re-establishing normal air flow cooling of said one modular cooling means.

2. The combination of claim 1, wherein said defrosting mode for each modular cooling means includes a defrosting period and a drip time period.

3. The combination of claim 1, wherein said defrost period is in the range of 3 to 40 minutes.

4. The combination of claim 2, wherein said drip time period is in the range of 0.5 to 5 minutes.

5. The combination of claim 2, in which the defrosting mode includes a cooling pull-down period of the defrosted modular cooling means at the end of the drip time period whereby to re-establish a normal refrigerating mode thereof.

6. The combination of claim 1, in which said defrosting mode for each modular coil is scheduled on a daily frequency of 3 to 24 times.

7. The combination of claim 6, wherein the scheduled length of time of the defrosting mode is inverse to the scheduled daily frequency of the defrosting mode.

8. The combination of claim 1, in which said defrosting means comprises coolant flow control means including valve means associated with the modular cooling means and controller means for operating said valve means.

9. The combination of claim 8, in which the coolant is a vapor phase refrigerant, and the coolant flow control means comprises an electronic expansion valve constructed and arranged on the high side of each modular cooling means.

10. The combination of claim 8, in which the coolant is a vapor phase refrigerant, and the coolant flow control means comprises electronic evaporator pressure regulating valve means constructed and arranged on the low side of the modular cooling means.

11. The combination of claim 8, in which the coolant flow control means comprises a normally open solenoid valve constructed and arranged on the high side of each modular cooling means.

12. The combination of claim 8, in which the coolant flow control means comprises a normally open solenoid valve constructed and arranged on the low side of each modular cooling means.

13. The combination of claim 8, in which said controller means comprises a programmed sequencer for the staggered defrost sequencing of the flow control valve means so that there is no concurrent defrosting of two modular cooling means.

14. The combination of claim 5, wherein said defrosting means comprises valve means associated with the respective modular cooling means and controller means for operating the valve means.

15. The combination of claim 14, wherein said controller means is programmed and arranged to establish the staggered defrost sequencing of the modular cooling means.

16. The combination of claim 15, in which said controller means programs an optimum period of concurrent normal refrigerating mode operation of all modular cooling means following the defrosting mode of each modular cooling means.

17. The combination of claim 1, wherein the defrosting mode of each modular cooling means is effected by off-time defrosting, and wherein the air flow circulation means is operative during such off-time defrosting.

18. In combination with a refrigerated merchandiser having an insulated cabinet with a product display area with at least two side-by-side product zones, at least two laterally disposed air flow systems constructed and arranged in said cabinet for circulating separate air flows to the respective product zones, and including a modular cooling coil associated with each of said air flow systems for normally providing an air flow cooling mode therein; the improvement comprising defrost means constructed and arranged in association with each modular cooling coil for discontinuing the cooling mode thereof and establishing an inoperative defrosting mode, and wherein the defrost means for one of said modular cooling coils is operational in its defrosting mode during the continuance of another of said modular cooling coils in its air flow cooling mode whereby refrigerated air flow into at least one zone of said product area is maintained at all times.

19. The combination of claim 18, wherein the defrosting mode is effected by off-time defrosting and wherein the air flow system for the modular cooling coil continues to operate during the defrosting mode thereof.

20. The combination of claim 18, wherein said defrost means comprises valve means constructed and arranged in the coolant flow path on one side of each modular cooling coil, and valve controller means for closing said valve means to effect the inoperative defrosting mode of said cooling coil.

21. The combination of claim 20, in which said controller means is programmed and arranged to establish a staggered defrost sequencing of the modular cooling coils whereby only one cooling coil is in its defrosting mode at a time.

22. The combination of claim 21, wherein the controller means establishes a pre-set defrosting mode sequence for each of the modular cooling coils in which there is an optimum defrost period followed by a drip time period and a refrigerating pull-down period.

23. The combination of claim 20, including coolant flow regulating means constructed and arranged in the coolant flow path on one side of the modular cooling coils in addition to said valve means.

24. The combination of claim 23, in which said coolant flow regulating means comprises expansion valve means on the high side of the modular cooling coils for metering liquid refrigerant flow.

25. The combination of claim 23, in which said coolant flow regulating means comprises EEPR valve means on the suction side of at least one modular cooling coil for regulating the refrigerant outflow from such coil.

26. The combination of claim 20, in which the coolant is a secondary heat transfer liquid, and in which the coolant flow control means includes other liquid flow regulating means for operating the normal cooling mode of the modular cooling coils.

27. The method of defrosting the cooling means of a refrigerated food merchandiser having an insulated cabinet with a product area and in which the cooling means comprises a plurality of modular coil sections for cooling separate air flows for circulation through the coil sections into contiguous zones of the product area, the method comprising the steps of:

(a) providing first means for accommodating coolant flow through one coil section during a normal cooling mode thereof;

(b) providing second means for accommodating coolant flow through another coil section during a normal cooling mode thereof; and (c) selectively operating the first and second means at different times so as to close one coil section to the flow of coolant for effecting a defrost mode while maintaining the normal cooling mode of the other coil section.

28. The method of defrosting according to claim 27, including the step of:

(d) operating the air flow means for continuing the circulation of air flows through the separate coil sections to the product area zones at all times.

29. The defrosting method of claim 27, in which the first and second means comprise coolant flow control valves, and in which step (c) includes:

(1) programming controller means to operate the flow control valves to initiate staggered sequencing of the coil sections in the defrost mode thereof.

30. The defrosting method of claim 29, in which step (c) further includes:

(2) programming the controller means to establish predetermined periods to accommodate a full ice melting time and a drip-time for each coil section.

31. The defrosting method of claim 30, in which step (c) further includes:

(3) programming the controller means to provide a pull-down period of the defrosted coil section following the drip-time period thereof whereby to re-establish a normal cooling mode thereof.

32. The defrosting method of claim 31, in which step (c) includes:

(4) programming controller means to provide an optimum period of concurrent cooling mode operation of all coil sections between the staggered defrost sequencing thereof.

33. A defrost method for maintaining product area temperature of a refrigerated merchandiser during defrosting, comprising the steps of:

(a) providing the merchandiser with a plurality of modular cooling coils and separate air flow means for circulating a separate air flow across each cooling coil to a separate zone of the product area, (b) operating the cooling coils in a refrigerating mode for normal cooling of the separate air flows to the separate product area zones, (c) establishing a defrost sequence for separately defrosting only one of said cooling coils at a time, and (d) continuing the refrigeration mode of another cooling coil during the defrost sequence to maintain normal cooling air flow to a product area zone adjacent to the zone of the air flow associated with the defrosting cooling coil.

34. The defrost method of claim 33, including the step of:

(e) operating the air flow means associated with the defrosting cooling coil during the defrost period to effect an off-time defrost.

* * * * *